US008881821B2

(12) United States Patent
O'Malley

(10) Patent No.: US 8,881,821 B2
(45) Date of Patent: Nov. 11, 2014

(54) BALL SEAT MILLING AND RE-FRACTURING METHOD

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 398 days.

(21) Appl. No.: 13/313,829

(22) Filed: Dec. 7, 2011

(65) Prior Publication Data

US 2013/0146291 A1 Jun. 13, 2013

(51) Int. Cl.
*E21B 43/26* (2006.01)

(52) U.S. Cl.
USPC ..... 166/308.1; 166/177.5; 166/305.1; 166/381

(58) Field of Classification Search
USPC ..... 166/55, 386, 376, 373, 332.4, 318, 317, 166/308.1, 297, 191, 177.5
See application file for complete search history.

(56) References Cited

U.S. PATENT DOCUMENTS

| | | | | |
|---|---|---|---|---|
| 6,651,738 | B1 | 11/2003 | Solfronk et al. | |
| 7,591,312 | B2 | 9/2009 | Johnson et al. | |
| 7,604,055 | B2 | 10/2009 | Richard et al. | |
| 7,681,654 | B1 * | 3/2010 | Cugnet | 166/387 |
| 7,958,940 | B2 | 6/2011 | Jameson | |
| 2005/0061551 | A1 * | 3/2005 | DeGeare et al. | 175/320 |
| 2005/0230107 | A1 * | 10/2005 | McDaniel et al. | 166/249 |
| 2008/0041597 | A1 * | 2/2008 | Fisher et al. | 166/381 |
| 2009/0151938 | A1 * | 6/2009 | Conkle et al. | 166/254.1 |
| 2010/0126725 | A1 | 5/2010 | Ravensbergen | |
| 2010/0243242 | A1 * | 9/2010 | Boney et al. | 166/250.01 |
| 2011/0067870 | A1 | 3/2011 | East, Jr. | |
| 2011/0114319 | A1 | 5/2011 | Xu et al. | |
| 2011/0220362 | A1 | 9/2011 | Huang et al. | |
| 2012/0325466 | A1 * | 12/2012 | Themig | 166/255.2 |

* cited by examiner

*Primary Examiner* — Jennifer H Gay
*Assistant Examiner* — Steven MacDonald
(74) *Attorney, Agent, or Firm* — Steve Rosenblatt

(57) ABSTRACT

A well that has a plurality of sliding sleeves used to originally fracture multiple zones with balls of increasing size dropped on balls seats to sequentially open ports for fracturing in a direction toward the well surface is refractured. The method involves using a bottom hole assembly (BHA) that has a fluid motor driven mill that mills out ball seats and has with it a ported sub and a resettable packer. Once the lowermost ball seat is milled out a ball is dropped into the BHA to isolate the fluid motor and open a ported sub below a resettable packer. The dropped ball also enables a collet to latch an open sleeve to give a surface signal that the BHA is located properly for packer deployment so that the refracturing can begin through the coiled tubing string that can support the BHA or in a surrounding annular space.

20 Claims, 4 Drawing Sheets

BALL SEAT MILLING AND RE-FRACTURING METHOD

FIELD OF THE INVENTION

The field of this invention is well re-fracturing and more particularly a technique for ball seat removal and re-fracturing through the open ports at the subterranean location in a single trip.

BACKGROUND OF THE INVENTION

Typical fracturing completions involve a series of sliding sleeves that provide formation access through a series of dropped balls on seats. The balls start off small to land on the smaller seats further from the well surface and pressure is built up to slide a sleeve so that a port is opened and the zone can be fractured through that port. The process is repeated working toward the well surface and dropping progressively larger balls on progressively larger seats associated with sleeves that open other ports for a continuation of the fracturing process until all the sleeves have been shifted open and fracturing has taken place through each opened sleeve. Each time a larger ball is dropped on a seat the open sleeves below are isolated and fracturing takes place through the single just opened sleeve with a ball in its seat. Some designs of such sleeves allow them to be shifted after fracturing to put a screen at the open port so that production can commence through the screened and open port. A shifting tool can be used after the fracturing is complete to close off the zones that will not be produced. Alternatively the shifting tool can be used to close producing zones if they produce undesirable fluids or sand. Normally production brings the balls up to the surface but this is not always the case as some may get hung up on the seat or seats that are further up.

The following patents relate generally to original fracturing and zone isolation to accomplish fracturing or to removal of barriers used to isolate zone for fracturing: U.S. Pat. Nos. 7,958,940; 6,651,738; 7,591,312; 7,604,055; U.S. Publication 2011/0220362; U.S. Publication 2011/0067870 and 2011/0114319.

The problem that arises if the well has to be re-fractured is that all the sliding sleeve valves with ball seats are still in the wellbore. The sliding sleeve valves could have been open for years and may not close. The presence of the ball seats can also impede progress of other tools to desired locations further down the wellbore. If the well requires refracturing there needs to be a way to isolate individual open ports so that the refracturing can be focused on specific ports for greater effectiveness. Additionally if the preparation of the existing wellbore and the refracturing can occur in a single trip then a greater advantage is achieved in cost savings. The present method allows the refracturing to take place after the bottom hole assembly mills up the ball seats in the existing sliding sleeves. The bottom hole assembly features a packer and a locating collet that allows the tool to enter a sliding sleeve after its seat has been milled out and isolate the open port so that a specific open port is refractured. The process continues up the wellbore until all the desired ports have had the refracturing process take place so that the bottom hole assembly can be removed and the well again put into production. These and other aspects of the present invention will become more readily apparent to a person skilled in the art from a review of the detailed description and associated drawings while recognizing that the full scope of the invention is to be determined by the appended claims.

SUMMARY OF THE INVENTION

A well that has a plurality of sliding sleeves used to originally fracture multiple zones with balls of increasing size dropped on balls seats to sequentially open ports for fracturing in a direction toward the well surface is refractured. The method involves using a bottom hole assembly (BHA) that has a fluid motor driven mill that mills out ball seats and has with it a ported sub and a resettable packer. Once the lowermost ball seat is milled out a ball is dropped into the BHA to isolate the fluid motor and open a ported sub below a resettable packer. The dropped ball also enables a collet to latch an open sleeve to give a surface signal that the BHA is located properly for packer deployment so that the refracturing can begin through the coiled tubing string that can support the BHA or in a surrounding annular space.

DETAILED DESCRIPTION OF THE PREFERRED EMBODIMENT

Figure 1:
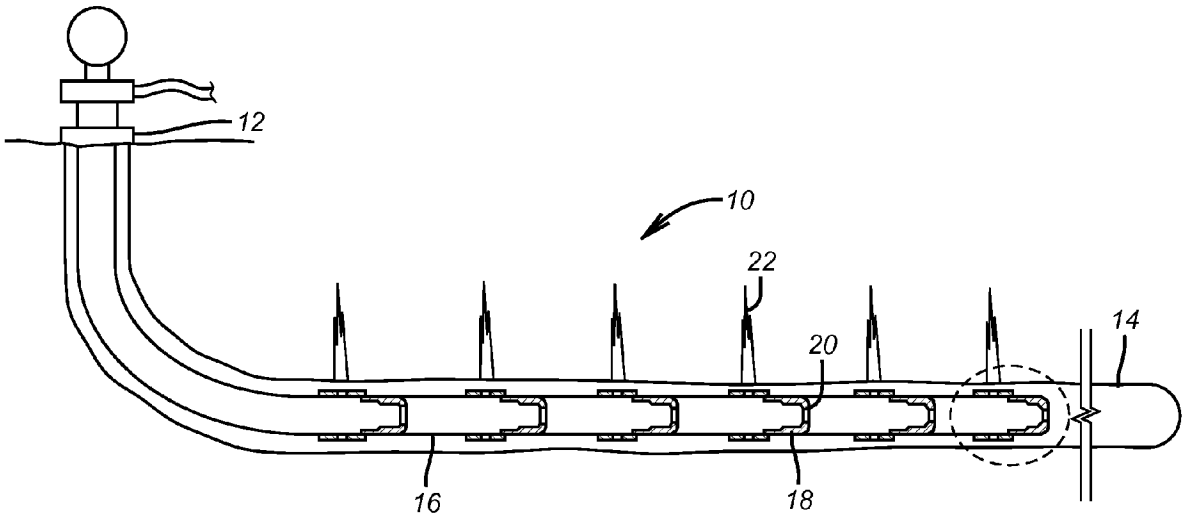
(PRIOR ART) FIG. 1
FIG. 1 is a schematic depiction of an array of sliding sleeves used for the initial fracturing.
Figure 2:
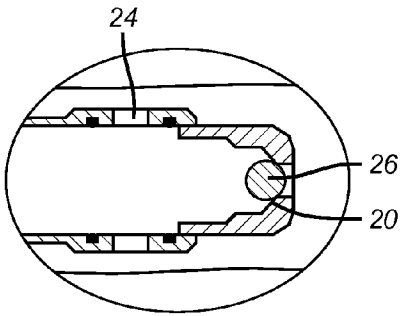
(PRIOR ART) FIG. 2
FIG. 2 is a detailed view of FIG. 1 showing a sliding sleeve valve in the open position.

FIG. 1 illustrates a wellbore 10 extending from a wellhead 12 to a long horizontal run 14. A tubular string 16 has a series of sliding sleeves 18 with each one having a ball seat 20 where the ball seats get larger as they get closer to the wellhead 12. Fractures 22 are made sequentially by sequentially opening ports 24, see FIG. 2, with a ball 26 dropped on seat 20. This is done with sequential use of larger balls so that the smallest ball will shift the sliding sleeve 18 furthest from the wellhead 12 and then the lowermost illustrated fracture 22 will be made first. The process repeats with progressively larger balls landing on other ball seats 20 that are closer to the wellhead 12. Each dropped ball isolates the fractures already made that are further downhole. After all the fractures 22 are made the well can be produced. Production sometimes takes all the balls 26 past any ball seats above and out through the wellhead 12 with the onset of production. If desired a shifting tool can be run in to close some of the sliding sleeves either initially or at a later point in time but in most cases this is not done and production proceeds from all the open ports 24 in the string 16.

At a much later time when there is a need to refracture the fractures 22, there is first the need to remove the ball seats 20. The bottom hole assembly or BHA to do this is shown in FIG.

Figure 8:
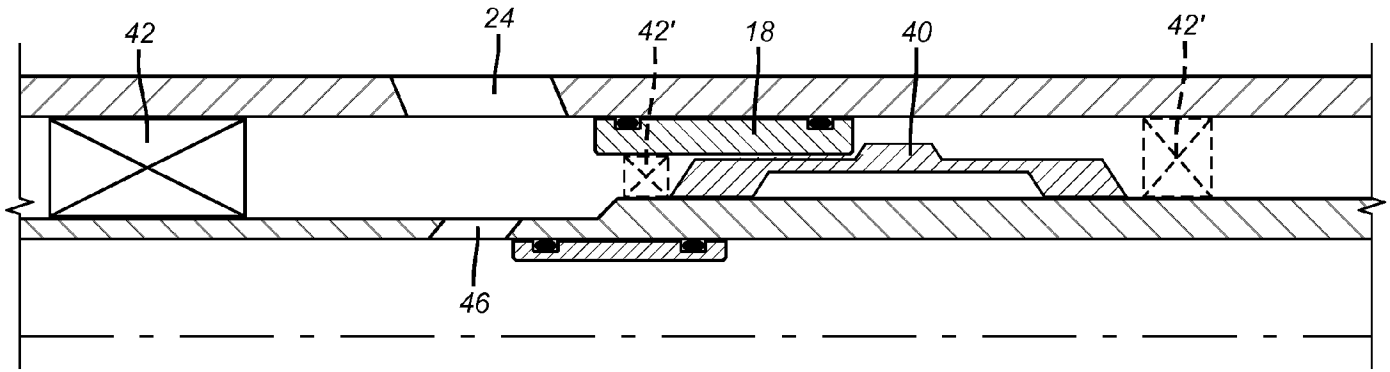
FIG. 8 shows the indicating collet positioning the open ported sub near an open sliding sleeve with at least one packer deployed so that refracturing fluid can be directed to the desired open port in an existing sliding sleeve.

3. Coiled tubing 28 is paid out from a spool 30 and through a gooseneck 32 and through a lubricator 34 that allows insertion of the BHA into the well 10 with the well still under pressure. A mill 36 is driven by a downhole progressing cavity or other type of fluid motor 38 or electric motor if run in on wireline. Suitable anchoring of a type known in the art can be coupled to the motor to facilitate the milling. A locating collet assembly 40 is held retracted for run in and during the milling operation to allow rapid deployment and to protect the assembly 40 from cuttings that result from the milling out of the ball seats 20. Adjacent the assembly 40 one configuration that enables refracturing through ports 24 in the tubular 16 is schematically illustrated. A resettable packer or plug 42 is shown adjacent a ported sub 44. The order shown can be reversed. The ports 46 in the configuration shown can frac an open port 24 through the annulus 48 if the packer is located below the open port 24 through which the refracturing will occur. On the other hand with the order reversed so that the packer 42 is above the ported sub 44 the ports 46 will be used to refracture an open port 24 and the annulus 48 above the packer 42 will be isolated as illustrated in FIG. 8. Another option is to use multiple spaced packers 42 that can straddle an open port 24 with the ported sub 44 ports 46 in between. The indicating collet 40 can optionally also be located between the spaced packers 42. FIG. 8 shows in dashed lines some alternative locations for a tandem packer 42' that can be to the left or to the right of the indicating collet 40 depending on the spacing of other nearby components.

Figure 4:
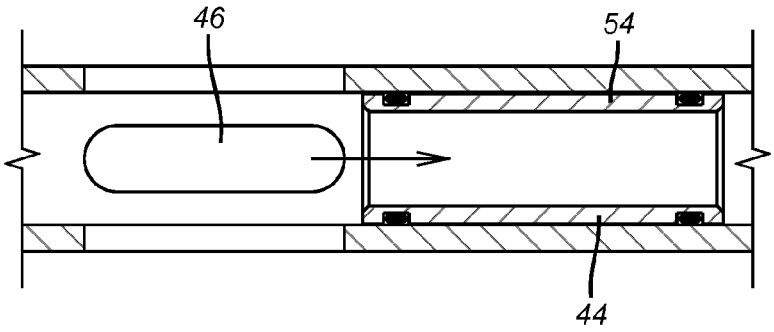
FIG. 4 shows an open port in the ported sub that can be used for the refracturing.
Figure 5:
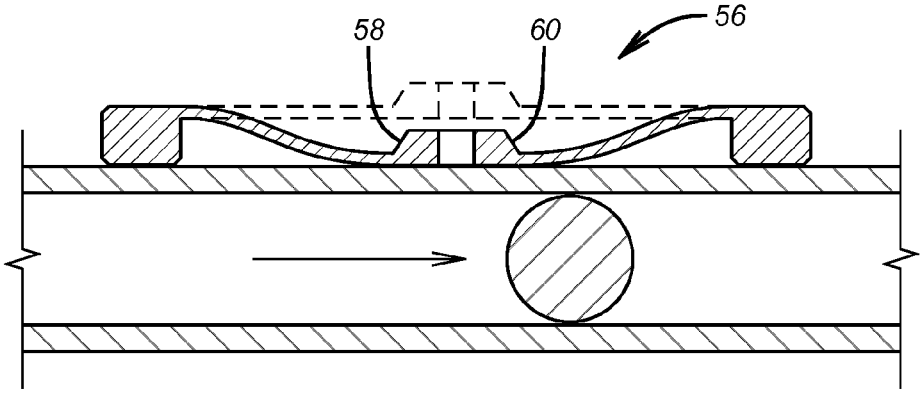
FIG. 5 shows the locating collet that can be used in the bottom hole assembly for location purposes near an existing sliding sleeve.
Figure 6:
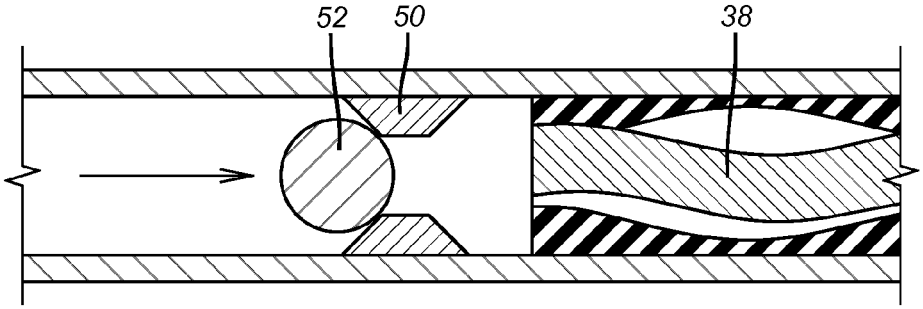
FIG. 6 shows a dropped ball into the bottom hole assembly to isolate the downhole motor that drives a mill.
Figure 7:
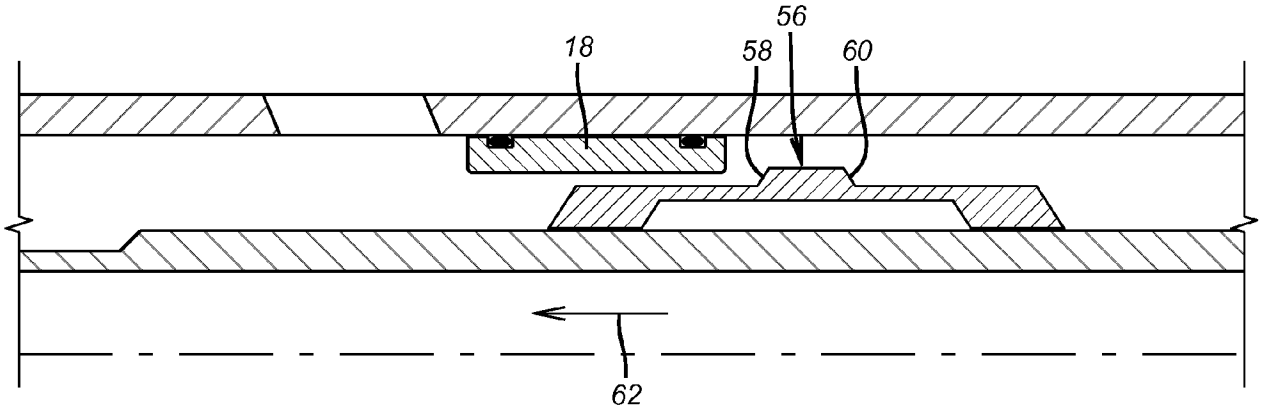
FIG. 7 is a detail of the indicating collet latched to an existing open sleeve.

FIGS. 4-6 illustrate additional details of the BHA. At the end of the milling out of the ball seats 20 the fluid motor 38 is isolated with a ball 52 dropped on seat 50. The same ball 52 can also shift a sleeve 54 in ported sub 44 to open ports 46. Alternatively the sleeve 54 can integrate the ball seat 50 so that the end result after the milling is done is that the motor 38 is isolated and the ports 46 are open and with the pair of packers 42 and 42' straddling the port 24 through which the refracturing will take place. The ball 52 can also trigger the radial release of the indicator assembly 40 which in the preferred embodiment is shown as a double ended flexible collet 56 that has opposed engaging surfaces 58 and 60. FIG. 7 shows surface 58 having already moved past the open sliding sleeve 18 so that on application of a pick up force in the direction of arrow 62 a surface signal will be given due to the encountered resistance. It should be noted that on movement initially in a direction opposite to arrow 62 that surface 60 will cause the collet assembly 56 to collapse radially inwardly to clear the sliding sleeve 18.

Figure 3:
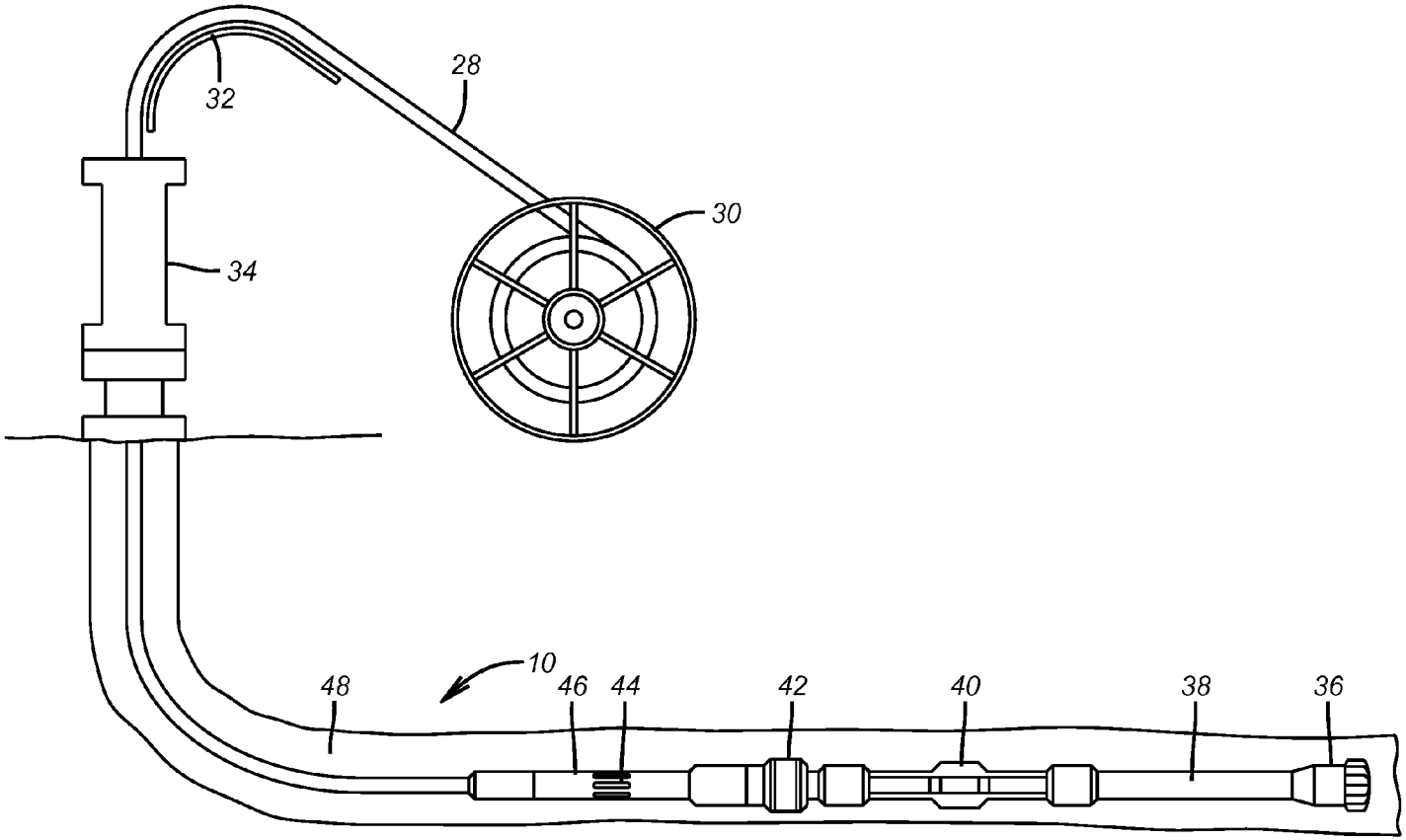
FIG. 3 schematically illustrates the bottom hole assembly that can be used in the inventive method.

The flexible collet 56 is used sequentially to reposition the BHA adjacent each of the ports 24 that are to be the refracturing locations until the job is complete and the BHA shown schematically in FIG. 3 is pulled out of the hole.

Those skilled in the art will appreciate that the method provides for removal of the ball seats 20 from the sliding sleeves 18 in the same trip as the positioning and repositioning of the BHA to then refracture through the open ports 24 in the string 16. The motor 38 is isolated at the conclusion of the milling and an access port 44 is opened preferably with a ball 52 landing on seat 50. Depending on whether a single packer 42 or a pair of spaced packers 42 and 42' the refracturing is either isolated into a single or multiple ports 24 with the rest of the well isolated or if only a single packer is used then only a part of the well is isolated depending on the location of the packer 42 with respect to the port 24.

The packer 42 or 42' can be set in a variety of ways such as coiled tubing manipulation, pressure on seated ball 52 or using flow. Although coiled tubing is preferred the method can also be performed with rigid tubing or even on wireline by setting the packer 42 below a port 24 and then pressurizing the wellbore against the set packer. The wireline will provide the power to the motor which in this variation will not be a progressing cavity type of motor.

While the preferred mode of the method is to remove all the seats and then isolate at least one port for refracturing from at least one other port in the string and refracture through all the open ports in that manner, the method envisions also milling less than all the seats and refracturing through less than all the available ports in the string.

The above description is illustrative of the preferred embodiment and many modifications may be made by those skilled in the art without departing from the invention whose scope is to be determined from the literal and equivalent scope of the claims below:

I claim:

1. A re-fracturing method for a subterranean location having a plurality of valves adjacent ports in a tubular string that were opened for earlier fracturing at the subterranean location by an object delivered to a seat thereon, comprising:

running in a string to at least one of said valves;

removing at least one seat associated with said valves with said string when said one of said valves is in an open position with respect to said port adjacent to said valve and removing cuttings from the subterranean location in an uphole direction toward a borehole entrance to the subterranean location;

isolating said at least one open port in said tubular string with said string from at least one other said port in said tubular string;

refracturing through said at least one open isolated port using said string;

performing said removing, isolating and refracturing in a single trip with said string to the subterranean location.

2. The method of claim 1, comprising:

milling all seats associated with all valves.

3. The method of claim 1, comprising:

using at least one resettable barrier for said isolating.

4. The method of claim 3, comprising:

positioning said resettable barrier adjacent one side of a port for said refracturing.

5. The method of claim 4, comprising:

using spaced apart resettable barriers in said bottom hole assembly;

straddling a port with said barriers for said refracturing.

6. The method of claim 3, comprising:

providing a ported sub adjacent said resettable barrier;

refracturing through said ported sub when said resettable barrier is set.

7. The method of claim 6, comprising:

opening said ported sub when setting said resettable barrier.

8. The method of claim 1, comprising:

performing said removing, isolating and refracturing with a bottom hole assembly run in on coiled tubing.

9. The method of claim 8, comprising:

providing a locating device on said bottom hole assembly.

10. The method of claim 9, comprising:

using a flexible collet as said locating device.

11. The method of claim 10, comprising:

engaging at least one valve with said collet for said locating.

12. The method of claim 8, comprising:

using a fluid motor and a mill to mill out said at least one seat;

isolating said motor and mill from said coiled tubing before said isolating and refracturing.

13. The method of claim 12, comprising:
using at least one resettable barrier for said isolating;
isolating said fluid motor and mill when actuating said resettable barrier.

14. The method of claim 12, comprising:
using at least one resettable barrier for said isolating;
providing a ported sub adjacent said resettable barrier;
isolating said fluid motor and mill when actuating said ported sub.

15. The method of claim 12, comprising:
using at least one resettable barrier for said isolating;
providing a ported sub adjacent said resettable barrier;
providing a locating device on said bottom hole assembly.

16. The method of claim 15, comprising:
engaging at least one valve with at least on flexible collet;
positioning said resettable barrier adjacent one side of a port for said refracturing.

17. The method of claim 1, comprising:
performing said removing, isolating and refracturing with a bottom hole assembly run in on wireline.

18. A re-fracturing method for a subterranean location having a plurality of valves adjacent ports in a string, said valves are operable by an object delivered to a seat thereon, comprising:
removing at least one seat associated with said valves;
isolating at least one open port in said string, associated with said valve having a seat removed, from at least one other port in said string;
refracturing through said at least one open isolated port;
performing said removing, isolating and refracturing in a single trip to the subterranean location;
performing said removing, isolating and refracturing with a bottom hole assembly run in on coiled tubing;
providing a locating device on said bottom hole assembly;
using a flexible collet as said locating device;
releasing said collet after milling all seats associated with all valves.

19. A re-fracturing method for a subterranean location having a plurality of valves adjacent ports in a string, said valves are operable by an object delivered to a seat thereon, comprising:
removing at least one seat associated with said valves;
isolating at least one open port in said string, associated with said valve having a seat removed, from at least one other port in said string;
refracturing through said at least one open isolated port;
performing said removing, isolating and refracturing in a single trip to the subterranean location;
performing said removing, isolating and refracturing with a bottom whole assembly run in on coiled tubing;
using a fluid motor and a mill to mill out said at least one seat;
isolating said motor and mill from said coiled tubing before said isolating and refracturing;
using at least one resettable barrier for said isolating;
providing a ported sub adjacent said resettable barrier;
providing a locating device on said bottom hole assembly;
engaging at least one valve with at least on flexible collet;
positioning said resettable barrier adjacent one side of a port for said refracturing;
releasing said collet after milling all seats associated with all valves;
isolating said fluid motor and mill when releasing said flexible collet for radial movement.

20. the method of claim 19, comprising:
providing a ported sub adjacent said resettable barrier;
isolating said fluid motor and mill when actuating said ported sub.

* * * * *